United States Patent [19]

Steffen

[11] 4,020,197

[45] Apr. 26, 1977

[54] PROCESS FOR THE CATALYTIC SENSITIZATION OF NON-METALLIC SURFACES FOR SUBSEQUENT ELECTROLESS METALLIZATION

[75] Inventor: Horst Steffen, Geldern, Germany

[73] Assignee: Kollmorgen Technologies Corporation, Dallas, Tex.

[22] Filed: Feb. 5, 1975

[21] Appl. No.: 547,360

[30] Foreign Application Priority Data

Feb. 22, 1974 Germany ..... 2409251

[52] U.S. Cl. ..... 427/304; 427/316; 106/1

[51] Int. Cl.[2] ..... C23C 3/02

[58] Field of Search ..... 427/304, 305, 306, 92, 427/98

[56] References Cited

UNITED STATES PATENTS

| | | | |
|---|---|---|---|
| 3,520,723 | 7/1970 | Sterman et al. | 427/306 X |
| 3,772,056 | 11/1973 | Polichette et al. | 427/306 X |
| 3,873,358 | 3/1975 | Lando | 106/1 |

*Primary Examiner*—Ralph S. Kendall
*Attorney, Agent, or Firm*—Morgan, Finnegan, Pine, Foley & Lee

[57] ABSTRACT

The present invention provides copper (I) ion compound bath solutions for the catalytic sensitization and metallization by electroless metal deposition of non-metallic surfaces, as well as processes for the application and re-claiming of said solutions.

19 Claims, No Drawings

PROCESS FOR THE CATALYTIC SENSITIZATION OF NON-METALLIC SURFACES FOR SUBSEQUENT ELECTROLESS METALLIZATION

BACKGROUND OF THE INVENTION

Until now, surfaces that were to be electrolessly metallized were treated for catalytic metallization with either colloidal noble metal dispersions or with solutions of a stannous chloride-noble metal complex, or the areas that were to be metallized were first treated, for example, with a solution of stannous chloride and subsequently, after careful rinsing, with a solution containing a noble metal chloride. A substantial disadvantage of these known processes is the high cost due to the consumption of noble metal. Another disadvantage is that metal sensitization processes of this type require accurate supervision, not only in order to avoid loss of noble metal, but also in order to ensure that no noble metal films, which adversely affect the adhesion of the subsequently deposited metallic coatings, are formed on metallic areas.

Another method that has been proposed is to treat the surfaces that are to be sensitized first with a solution of a reducible metallic salt chosen from among copper, nickel, cobalt and iron salts and subsequently, preferably after drying, to reduce the deposited metallic salt by the action of heat or a reducing agent suitable for the particular metallic salt to form catalytically active metallic nuclei, and then to produce on the surface thus sensitized a metallic coating by electroless deposition by means of suitable baths. What has proved to be particularly disadvantageous is that surfaces catalytically sensitized in this manner show a relatively low catalytic activity and that for effective sensitization, i.e., formation of catalytically active nuclei, extremely active reducing agents are required, for which labor supervision and re-claiming are complicated and expensive.

The disadvantages described are avoided by use of the present invention, and the catalytic sensitization of plastic surfaces for electroless metallic deposition is achieved in a simple manner that is both operationally dependable and economical.

An object of the present invention is to make sensitizing solutions which are free from noble metals with high activity. A further object of the present invention is to sensitize surfaces for subsequent electroless metal deposition by means of a simple and economical process for the use and re-claiming of the sensitizing solutions.

DESCRIPTION OF THE INVENTION

According to the invention, the bath solution for the metallization of plastic surfaces comprises, among other suitable ingredients, a catalytically active compound containing copper (I) ions.

The surface treated with the copper (I) ion-containing solution is rinsed with water in order to remove excess metallic ions from the material surface and to convert the copper (I) ions, by hydrolysis, into insoluble compounds which are absorbed by the non-metallic surface. Subsequently, the surface thus pretreated is introduced into a solution which is suitable for reducing copper (I) ions to elemental copper, whereby highly active nucleus-positions are produced for subsequent electroless metal deposition.

Special reducing agents can be used for the reduction step, such as alkaline alkali boranate solutions (e.g., sodium boranate), alkaline hydrazine hydrate solutions, acidic hypophosphite solutions (e.g., sodium hypophosphite), alkaline formaldehyde solutions and the like, or the reduction can be achieved directly in the electroless metallization baths by means of reducing agents contained therein.

For the catalytic sensitization solution, almost all those copper (I) compounds are suitable which form ionic solutions including such solutions of a complex compound in a solvent wherein the compound and/or its hydrolysis products have a solubility product so low that they are sparingly soluble or virtually insoluble in water.

Copper (I) chloride, which is virtually insoluble in water is one such compound. It can form a complex with chloride ions and be solubilized in this way:

$$CuCl + Cl^- = [CuCl_2]^-$$

The present invention, therefore, contemplates in its broadest aspects;

i. treating a surface to be metallized with a sensitizing solution comprising a copper (I) ion compound capable of forming ionic solutions including such solutions of a complex compound and a solvent therefor, the compound and/or its hydrolysis products having a solubility product so low that they are sparingly soluble or insoluble in water;
ii. subsequently rinsing the excess solution from the so-treated surface with water, whereby the copper compound is hydrolyzed and anchored firmly to the surface; and thereafter
iii. exposing the surface to a solution containing a reducing agent or agents to form active nuclei for electroless metal deposition by reduction of said copper (I) compound.

Preferred features of the invention are:

1. use of an insulating material as the article the surface of which is to be metallized;
2. the sensitizing solution contains a surface-active, or wetting, agent (preferably a fluorinated hydrocarbon);
3. the copper (I) compound is heated for use, e.g., by heating the solution, preferably to about 40° C.;
4. the surface to be metallized is pre-heated before being treated with the sensitizing solution;
5. the copper (I) compound in solution forms a copper (I) halogen complex compound (preferably $(CuCl_2)^-$) or a compound of the acid $H(CuCl_2)$ or $Cu(NH_3)_4^+$ (preferably $Cu(NH_3)_4Cl$);
6. as an alternative, the copper (I) compound to be used can be copper hydride, with pyridine as the solvent, in which case the surface to be metallized, after being treated with the sensitizing solution and rinsed to remove excess solution, is dried at a temperature sufficient to cause the decomposition of the copper hydride and formation of active nuclei.

As an alternative process, the solution containing a reducing agent or agents is used as the latter solution employed for the electroless metal deposition, and formation of the active metal nuclei is brought about by means of the reducing agent in the metallizing bath solution.

The present invention also contemplates, in its broadest aspects:

A sensitizing solution for the formation of catalytic nuclei on a surface to be electrolessly metallized, said solution comprising a copper (I) ion compound capable of forming an ionic solution including such solution of a complex compound and solvent therefor, the compound and its hydrolysis products having a solubility product so low that they are sparingly soluble or insoluble in water.

Since the effectiveness of the sensitizing solution is diminished as the copper (I) contained therein is oxidized to copper (II) by contact with air, the sensitizing solution can be passed over metallic copper, preferably at an elevated temperature, in order to re-claim the copper (I) by reduction of copper (II).

DESCRIPTION OF THE PREFERRED EMBODIMENTS

The following Examples illustrate the process of the present invention and describe the metallized article prepared thereby. They are illustrative and are not to be construed to limit the invention.

EXAMPLE I

60–68 g/l CuCl are dissolved in 10–15% HCl. As can be seen from the reaction equation, the positive hydrogen ion of the hydrochloric acid is not required as cation, but CuCl can be satisfactorily solubilized, for example, by means of sodium chloride. The bath solutions according to the invention are not restricted to chlorides. Other copper (I) halides or copper (I) compounds can be used, provided that they form an ionic or complex solution in a suitable solvent and show a solubility product which causes them to be sparingly soluble or insoluble in water. Solutions of copper (I) chloride in HCl are oxidized (with relative rapidity) by atmospheric oxygen. In order to ensure that the solution of the sensitizing bath retains its effectiveness unaltered, it is desirable to bring the solution of the copper (I) compound into contact with elemental copper. One way of doing this is to pump the sensitizing solution over the copper whereby copper (II) ions formed according to the equation $CuCl_2 + Cu^\circ = 2CuCl$ are reduced back to copper (I) ions and the content of $[CuCl_2]^-$ is replenished at the same time according to the equation $CuCl + HCl \rightarrow H[CuCl_2]$. The solution that is to be reclaimed can be suitably brought into contact with the elemental copper at an elevated temperature.

With the aid of this process for reclaiming of the bath solution for catalytic sensitization, the stability of this solution is maintained in a simple and reliable manner, which leads to a considerable increase in operational dependability and reduction in operational costs.

Moreover, it is desirable that the sensitizing bath solution contain a surface-active agent, preferably a fluorinated hydrocarbon.

An illustration of the process for the metallization of plastics by means of a bath solution for catalytic sensitization is the following:

EXAMPLE II

The surface of the object to be metallized which has been pre-treated by one of the prior art methods, is first immersed in 15% hydrochloric acid and subsequently treated in the sensitizing solution, consisting of:

i. about 60–80 g/l of CuCl;
ii. about 0.01 g/l of surface-active agent (fluorinated hydrocarbon); and
iii. about 150 ml/l conc. of hydrochloric acid.

The solution is maintained for 15 minutes at a bath temperature of 40° C., the surface of the object which is to be sensitized preferably being kept in motion and the sensitizing solution being pumped over metallic copper turnings.

Thereafter, the surface is rinsed with tap water for about 30 seconds and then introduced into deionized water for about 60 seconds, in order to bring about hydrolysis of the copper (I) compound present on the surface.

The surface is then treated with the reducing agent solution. As an illustration, the reducing agent solution can consist of:

i. about 1 g/l of $NaBH_4$;
ii. about 0.4 g/l of NaOH; and
iii. about 1 ml/l of 1% wetting agent solution.

The solution is maintained for 7–10 minutes at 30° C., the article to be metallized preferably being kept in motion, and then rinsed in demineralized water for 10 minutes. Subsequently, the electroless metal deposition, such as electroless copper plating, is carried out.

Instead of being treated with a separate reducing agent solution, the surface can be introduced, after hydrolysis, directly into a suitable electroless metallization bath in order to effect therein the formation of active nuclei by means of the reducing agent present. For the pre-treatment of the plastic surfaces to be metallized, the latter may be rendered microporous and wettable by one of the methods known in the prior art, such as by means of chromic-sulfuric acid, and then cleaned, for instance, by means of alkaline degreasing baths.

For surfaces which are difficult to etch by oxidizing agents, such as epoxy resin surfaces, it has proved expedient first to render them polar temporarily. A solvent mixture consisting of methyl ethyl ketone, methanol and a wetting agent can be used to do this.

EXAMPLE III

This Example provides a combination of suitable process steps for the metallization of plastics:

Process Steps

A-1 Variant:

Pre-treating the plastic surface with a solution for rendering the surface temporarily polar, e.g., with a mixture consisting of methyl ethyl ketone, methanol and a surface-active agent.

A-2 Variant:

Producing a polar and microporous surface, e.g., by chemical etch with chromic-sulfuric acid solution, with subsequent reduction of the chromium and rinsing.

A-3 Variant:

Alkaline cleaning of the surface and rinsing with water.

1. Immersing in 15% HCl solution for 5 minutes at room temperature.
2. Immersing in copper (I) ion solution consisting of 80 g/l of CuCl, 150 ml/l of conc. HCl, 0.01 g/l of surface-active agent (preferably a fluorinated hydrocarbon) for 15 minutes at 40° C. the article to be sensitized being kept in motion, and the sensitizing solution being pumped over metallic copper.
3. Rinsing for 30 seconds in tap water and treating for 60 seconds in de-ionized water, in order to hydrolyze the copper (I) compound.

4. Introducing into a solution of 1 g/l of $NaBH_4$, 1 g/l of NaOH and 1 ml/l of the 1% solution of a surface-active agent for 7–10 minutes at 30° C., the article to be sensitized being kept in motion, for the purpose of forming active nuclei.
5. 10 minutes of rinsing in de-ionized water.
6. Electroless copper plating in known baths.

Instead of Steps 4 and 5, the surface can be introduced directly into a suitable electroless copper plating bath, wherein the formation of active nuclei is effected by the reducing agent present in the bath.

Steps A-1, A-2 and A-3 represent examples of well-known pre-treatments which are applied alone or in combination, as necessary, depending on the synthetic material in question.

Further examples of catalytic sensitizing solutions are the following:

EXAMPLE IV i. from about 60 to about 80 g. of CuCl;
ii. about 0.01 g. of fluorinated hydrocarbon surface-active agent;
iii. about 150 g. of sodium chloride;
iv. about 20 ml. of conc. hydrochloric acid; the balance, to 1 liter, comprising water.

EXAMPLE V i. from about 60 to about 90 g. of CuCl;
ii. from about 150 to about 200 g. of NaCl;
iii. about 0.01 g. of a fluorinated hydrocarbon surface-active agent; and
iv. about 10 ml. of concentrated hydrochloric acid, the balance, to 1 liter, comprising water.

EXAMPLE VI i. from about 60 to about 90 g. of CuCl;
ii. about 150 ml. of concentrated hydrochloric acid; and
iii. about 0.01 g. of a fluorinated hydrocarbon surface-active agent, the balance, to one liter, comprising water.

EXAMPLE VII i. from about 60 to about 80 g. of CuCl;
ii. about 0.01 g. of a fluorinated hydrocarbon wetting agent;
iii. about 150 g. of $NH_4Cl$; and
iv. about 15 ml. conc. of hydrochloric acid, the balance, to 1 liter, comprising water.

EXAMPLE VIII i. about 50 g. of CuCl;
ii. about 0.01 g. of a fluorinated hydrocarbon surface-active agent;
iii. about 100 g. of $CaCl_2$; and
iv. about 20 ml. conc. hydrochloric acid, the balance, to 1 liter, comprising water.

EXAMPLE IX

From about 50 to about 100 g. of CuCl. dissolved in excess ammonia.

EXAMPLE X

A reducing agent solution comprising, per liter:
i. about 1.0 g. of $NaBH_4$;
ii. about 0.4 g. of NaOH; and
iii. about 1.0 ml. of a 1% aqueous solution of a surface-active agent, the balance comprising water.

The solutions can be used at room temperature or, preferably, at elevated temperature, the activity increasing with temperature. It has proved advantageous for the further improvement of sensitization to pre-heat the object to be sensitized before introducing it into the sensitizing solution.

The fact that the Examples have illustrated the use of copper (I) chloride should not be taken to mean that other copper (I) halogen compounds or, quite generally, copper (I) components are not to be used.

Further Examples with compounds of this kind will be obvious. However, in order to keep the specification free from unnecessary detail, it should only be pointed out further that a solution of copper hydride in pyridine has proved to be particularly suitable. In the case of this type of solution, it is merely necessary to dry the treated surface at a temperature at which the copper hydride is decomposed, as a result of which elementary, catalytically effective copper nuclei are immediately formed.

I claim:

1. A process for the formation of catalytic nuclei on a surface to be metallized comprising:
i. treating said surface with a sensitizing solution comprising a copper (I) ion compound capable of forming ionic solutions including such solutions of a complex compound and a solvent therefor, the compound and/or its hydrolysis products having a solubility product so low that they are sparingly soluble or insoluble in water;
ii. subsequently rinsing the excess solution from the so-treated surface with water, whereby the copper compound is hydrolyzed and anchored firmly to the surface; and thereafter
iii. exposing the surface to a solution containing a reducing agent or agents to form active nuclei for electroless metal deposition by reduction of said copper (I) compound.

2. A process as defined in claim 1 wherein said surface is on an insulating material.

3. A process as defined in claim 1 wherein the solution containing a reducing agent or agents is used as the bath solution employed for the electroless metal deposition, and whereby formation of the active metal nuclei is effected by means of the reducing agent in said metallizing bath solution.

4. A process as defined in claim 1 wherein said sensitizing solution also contains a surface-active agent.

5. A process as defined in claim 4 wherein said surface-active agent is a fluorinated hydrocarbon.

6. A process as defined in claim 1, wherein said sensitizing solution is passed over metallic copper during use.

7. A process as defined in claim 6 wherein said sensitizing solution is passed over metallic copper at an elevated temperature.

8. A process as defined in claim 1 wherein said sensitizing solution comprises a copper (I) halogen complex compound.

9. A process as defined in claim 8 wherein said copper (I) complex compound is the complex chlorine compound $(CuCl_2)^-$ or a compound of the acid H $(CuCl_2)$.

10. A process as defined in claim 1 wherein said sensitizing solution comprises a copper (I) ion compound containing $Cu(NH_3)_4^+$.

11. A process as defined in claim 10 wherein the anion of said copper (I) compound is chloride.

12. A process as defined in claim 1 wherein said copper (I) ion compound is copper hydride and said solvent is pyridine.

13. A process as defined in claim 12 wherein said surface after rinsing of the excess solution from it with water is dried at a temperature which is adequate to cause the decomposition of the copper hydride and the formation of active nuclei.

14. A process as defined in claim 1 wherein said reducing agent solution is selected from among alkaline alkali boranate solutions, alkaline hydrizine hydrate solutions, acidic alkali hypophosphite solutions and alkaline formaldehyde solutions.

15. A process as defined in claim 14 wherein said alkaline alkali boranate solution comprises sodium boranate.

16. A process as defined in claim 14 wherein said acidic alkali hypophosphite comprises sodium hypophosphite.

17. A process as defined in claim 1 wherein said copper (I) compound is heated for use.

18. A process as defined in claim 17 wherein said copper (I) compound is heated to about 40° C.

19. A process as defined in claim 1, wherein the surface to be metallized is heated before being treated with said sensitizing solution.

* * * * *

Notice of Adverse Decision in Interference

In Interference No. 100,101, involving Patent No. 4,020,197, H. Steffen, PROCESS FOR THE CATALYTIC SENSITIZATION OF NONMETALLIC SURFACES FOR SUBSEQUENT ELEFTROLESS METALLIZATION, final judgment adverse to the patentee was rendered Nov. 18, 1980, as to claims 3, 15 and 19.

[*Official Gazette April 14, 1981.*]